United States Patent [19]

Pound et al.

[11] 4,113,534

[45] Sep. 12, 1978

[54] PAPER PULP INSULATED CABLE AND METHOD OF MANUFACTURE

[75] Inventors: Thomas Charles Pound, Kingston; Eric John Gouldson, Shawbridge, both of Canada

[73] Assignee: Northern Telecom Limited, Montreal, Canada

[21] Appl. No.: 672,366

[22] Filed: Mar. 31, 1976

[51] Int. Cl.[2] ..... H01B 13/06; H01B 3/52

[52] U.S. Cl. ..... 156/56; 29/624; 162/106; 174/110 P

[58] Field of Search ..... 174/27, 34, 110 P, 122 R, 174/119 C, 124 R, 113 R; 427/117, 120, 121, 180, 394, 395, 396, 397; 428/393; 162/106, 138, 218, 224; 29/624; 156/51, 56; 57/145–148

[56] References Cited

U.S. PATENT DOCUMENTS

| | | | |
|---|---|---|---|
| 1,615,418 | 1/1927 | Walker et al. | 174/124 R X |
| 2,051,423 | 8/1936 | Schacht | 174/124 R X |
| 2,379,756 | 7/1945 | Selvig | 174/124 R X |
| 2,687,677 | 8/1954 | Krogel | 162/106 |
| 3,059,046 | 10/1962 | Westervelt et al. | 174/119 X |
| 3,662,091 | 5/1972 | Jachimowicz et al. | 174/110 P |
| 3,917,901 | 11/1975 | Jones | 174/110 P |

FOREIGN PATENT DOCUMENTS

| | | | |
|---|---|---|---|
| 45-2,948 | 10/1966 | Japan | 427/117 |

OTHER PUBLICATIONS

Alexander, D. C., *Modern Trends in Communications--Cable Manufacture*, Wire & Wire Products, Sep. 1972, pp. 55–56.

*Primary Examiner*—Arthur T. Grimley

[57] ABSTRACT

A paper pulp insulated cable of the kind having a plurality of conductors covered with paper pulp insulation. The insulated conductors are twisted into pairs, the pairs are stranded into units and the units are built up into cores, covered with, for example, a paper wrap, aluminum, steel sheath and a polyethylene jacket. The cable has a high density of conductors. Also a method of manufacturing such cables is described.

23 Claims, 3 Drawing Figures

PAPER PULP INSULATED CABLE AND METHOD OF MANUFACTURE

The present invention relates to electrical cables and particularly to paper pulp insulated cables, and methods of their manufacture.

Paper pulp insulated cables typically contain from a few tens of pairs of conductors to a few thousand pairs of conductors. A conductor is covered with paper pulp insulation, and two insulated conductors are twisted into a pair. The pairs are then grouped into a unit, typically 100 pairs per unit, which are then built up into cores containing typically from 300 to 3,600 pairs. The cores are then sheathed, for example, with a paper wrap and an overlay of aluminum, then steel, a flooding compound, and an outer low density polyethylene jacket. Such cables are well known and have been commercially available for approximately 50 years.

In certain applications, where large cables are used, it is important that the outside diameter of the cables be as small as possible. An example might be helpful. A typical prior art 3,600 pair cable of 26 AWG copper conductor had an outside diameter of 3.31 inches and a 3,000 pair cable was 2.99 inches. In certain installations e.g. in the center of large cities, telephone cables are located in underground ducts which are buried beneath the street. At the approaches to the central office the density of underground cable (which are in ducts) is very high. Furthermore, in some cities there is very little space for new ducts and for the installation of new cable. Certain utilities, which have priority over telephone cables, take the upper portion of the space available beneath the street. Sewer lines must have a certain slope and therefore take first priority; water mains, fire hydrants, subways, pneumatic distribution systems, steam lines and power distribution lines all tend to get the upper or closest to the street priority. The result is that telephone cables are placed beneath the other utility spaces and in certain instances have extended 100 feet below the surface. When it is necessary to add telephone cables it is very difficult and expensive or impossible to carve space for the new ducts below the existing ones. An additional constraint is the size of the duct which limits the diameter of the cable that can be installed therein.

Thus cables with high pair density become in great demand in certain new installations or to replace existing low density types. New cables with 15 percent more conductor pairs, and the same outside diameter, at times make it commercially expedient to pull out from the ducts the old cables, and replace them with the new high density cables. By way of an example a high density cable having the same gauge wire and electrical characteristics as old cable for 3,600 pairs has an outside diameter of 3.08 ± 0.02 inches instead of 3.31, and a 3,000 pair cable has 2.90 ± 0.02 inches instead of 2.99.

Although the new cable has been initially used where space is at a premium, it is thought the cable may have general application wherever paper pulp insulated cable is needed.

Figure 1:
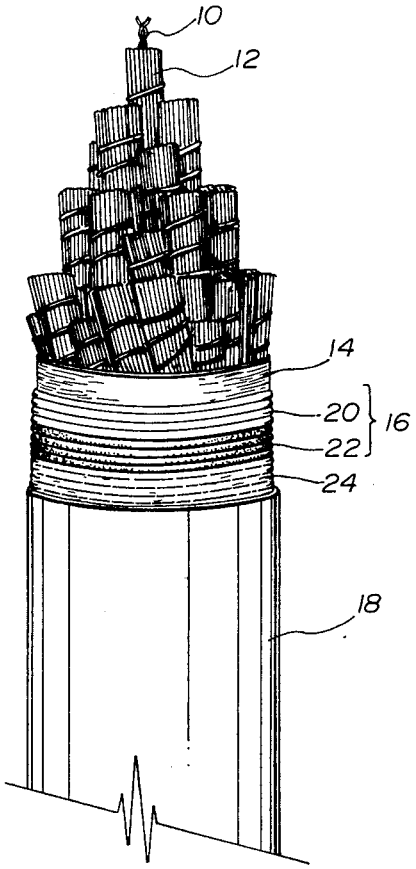
FIG. 1 is a plan view of a paper pulp insulated cable cut away in part to expose its constituents.

Referring now to FIG. 1 there is shown two insulated conductors twisted into a pair 10. The pairs are stranded and bound into units 12, typically 100 pairs per unit. The units are built up or cabled into cores containing typically from 300 to 3,600 pairs.

The core is then wrapped with a paper tape 14, which is then sheathed, i.e. placed in metal sheath 16, and then protected with a plastic or rubber jacket 18. The sheathing typically is 8 mil (1 mil = 1/1,000 inch) aluminum 20 and 6.1 mil tin-plate steel 22 transversely corrugated. The steel may be soldered at its seam. A flooding compound 24 is applied over the steel to prevent corrosion of the steel, over which is applied the plastic jacket 18 which for example is low density polyethylene.

A typical cable with 26 AWG, solid annealed copper conductor, 102% conductivity (Matthiessen's Standard) would have the following electrical characteristics:

- Conductor Resistance at 20° C. (ohms/loop mile)
  - Nominal—172
  - Maximum—186
- Inductance at 1000 Herz (Hertz/mile)
  - Nominal—0.001
- Insulation Resistance at 15.5° C. (megohm miles)
  - Minimum—1000
- Average Mutual Capacitance at 900 Hertz at 15.5° C. (microfarads/mile)
  - Nominal—0.083
  - Maximum—0.090
- Dielectric Strength (volts RMS)
  - Conductor-to-conductor 350
  - Conductor-to-shield 1000
- Nominal Characteristic Impedance at 1000 Herz
  - Non-loaded
    - Resistance (ohms) 576
    - Negative angle (degrees) 44
  - H-88 loading
    - Resistance (ohms) 1051
    - Negative angle (degrees) 10
- Conductance at 900 Hertz at 15.5° C. (micromhos/mile)
  - Nominal—2.25
- Nominal Altenuation at 1000 Hertz at 20° C. (decibels/mile)
  - Non-loaded—1.75
  - H-88 loading—0.79

The important electrical characteristic is the mutual capacitance: 0.083 microfarad per mile. This is an industry standard for telephone use.

Figure 2:
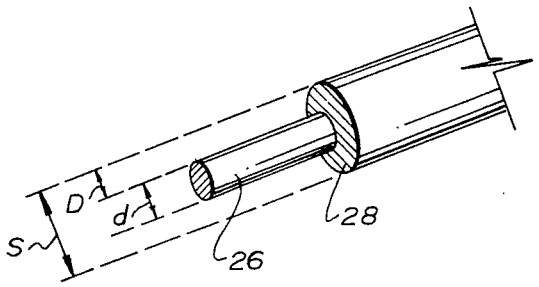
FIG. 2 is a perspective view of a single conductor with paper pulp insulation of the kind in the cable of FIG. 1.

Referring now to FIG. 2, there is shown a single conductor 26 having a diameter *d*, with paper pulp insulation 28 partially cut away and having an outside diameter *s*. For 26 AWG copper conductor, the paper pulp insulation has a density of approximately 0.42 grams/cm$^3$, and a wall thickness D of approximately 5 mil. A satisfactory measured range of density is 0.44 to 0.40 grams/cm$^3$. Density is measured on dry insulation. The measurement is taken after the insulation has remained in an oven at 105° C. for 10 to 15 minutes.

For 28 AWG copper conductor, the insulation density is approximately 0.44 ± 0.02 grams/cm$^3$, and a wall thickness of 4 mil.

For 24 AWG copper conductor, the insulation density is approximately 0.39 ± 0.03 grams/cm$^3$, and a wall thickness of 7 mil.

For 22 AWG copper conductor, the insulation density is approximately 0.39 ± 0.03 grams/cm$^3$, and a wall thickness of 8.6 mil.

For 19 AWG copper conductor, the insulation density is approximately 0.37 ± 0.04 grams/cm$^3$, and a wall thickness of 10.2 mil.

Figure 3:
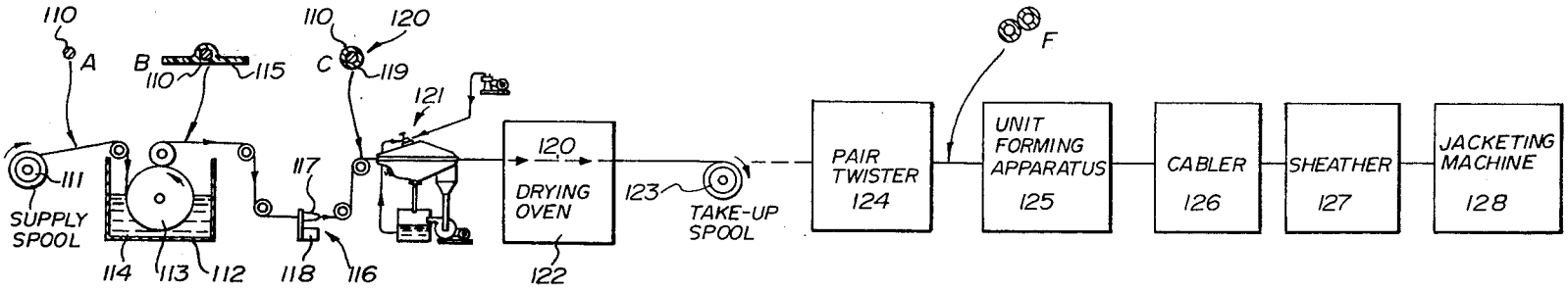
FIG. 3 is a schematic diagram illustrating the different stages in forming paper pulp insulated cable.

Referring now to FIG. 3, there is schematically shown a continuous strand of copper wire conductor 110, shown in cross section at A being unwound from a supply spool 111 into a pulp vat 112 where it passes around a cylinder mold 113 partially submerged in a paper pulp liquid or slurry 114.

Conductor 110 emerges from vat 112 imbedded in a strip coating 115 of paper pulp as shown in cross section B. Coated wire 110 next passes through a polisher 116 between elements or shoes 117 axially rotated by a motor 118 which folds lateral portions of strip coating 115 around the wire to form an annular sheath or layer of insulation 119 producing an insulated conductor 120 as shown in cross section C. From polisher 116 the insulated conductor 120 may pass through a color coding machine 121 which colors the insulation. Upon emergence therefrom, the insulated conductor 120 passes into a drying oven 122 where the moisture carried by insulation 119 from pulp vat 112 and color coding machine 121 is evaporated resulting in an insulated conductor which is then wound on a take up spool 123. Two insulated conductors are then fed into a twisting apparatus 124 which forms them into pairs as shown in cross section at F. A plurality of pairs are fed to a unit forming apparatus 125 which strands and binds the twisted pairs into a unit of typically 100 pairs per unit. A unit is shown in FIG. 1 with legend 12. The units are fed to a cabler 126 where the units are grouped and then sheathed.

On the cabler 126 the units may be rotated around one another into cores (for example in a 36 inch lay). The cores are then wrapped with paper tape, after which they are sheathed in a sheather 127 typically with a stalpeth sheathing (aluminum, steel, and polyethylene). Over the core wrap paper 14, and 8 mil aluminum 20 (FIG. 1) and 6.1 mil tin plate steel 22 transversely corrugated are formed longitudinally around the core. In a jacketing machine 128, a flooding compound 24 (e.g. asphalt rubber) is applied over the steel after which polyethylene is extruded over the compound.

The steps may be performed in batches. Drying may be required of the paper pulp and paper wrap to ensure proper dryness. For those unfamiliar with the general process or wishing more detail, reference is made to "The Western Electric Engineer" vol. XV. No. 3 (1971) pages 86–94.

The paper pulp slurry typically has kraft soft wood pulp fibers with an average length of 2.5 mm. A satisfactory distribution from average is 30% of the fibers (dry weight) do not pass a No. 10 mesh (3.75 mm); 27% a No. 14 mesh (3.05 mm); 21% a No. 28 mesh (2.00 mm); 10% a No. 48 mesh (1.23 mm); and 11% pass the No. 48 mesh.

The pulp is disintegrated and refined, and has a Freeness Value of 480 milliliters Canadian Standard Freeness (Standard D 3396 - ASTM Pulp Test Series).

The amount of paper pulp or strip coating 115 applied to the conductor 110 is 0.0286 grams/foot (dry weight) for 26 AWG copper with a typical variation of ±0.0004 gram/foot; is 0.0194 gram/foot for 28 AWG copper; 0.0491 gram/foot for 24 AWG copper; 0.0697 gram/foot for 22 AWG copper; and 0.1080 gram/foot for 19 AWG copper, all measures with a permissible variation of ±2%.

The drying oven 122 is 26 feet long and has three adjacent equal length furnaces with heating sources four feet long through which the insulated conductor 120 sequentially pass at temperatures of 1600° F.; 1150° F.; 875° F. at a typical speed of 200 feet per minute for 25 AWG copper; 1500° F.; 1150° F.; 650° F. at a speed of 200 feet/minute for 28 AWG copper; 1600° F.; 1300° F.; 1000° F. at a speed of 200 feet/minute for 24 AWG copper; 1600° F.; 1400° F.; 1100° F. at a speed of 180 feet/minute for 22 AWG copper; and 1600° F.; 1300° F.; 900° F. at a speed of 150 feet/minute for 19 AWG copper. After drying the insulation should have a water content of between 3–8% for 28 AWG, 26 AWG and 24 AWG copper, and between 4–10% for 22 AWG and 19 AWG copper.

The drying step in addition to removing water from the paper pulp insulation also "fluffs" the insulation, so that it has a density of 0.42 ± 02 grams/cm$^3$ (dry weight) for 26 AWG copper; approximately 0.44 grams/cm$^3$ for 28 AWG copper; approximately 0.39 grams/cm$^3$ for 24 AWG copper; approximately 0.39 grams/cm$^3$ for 22 AWG copper and approximately 0.37 grams/cm$^3$ for 19 AWG copper.

The temperature may be adjusted to provide the proper density. For example the first stage furnace may be varied by ±100° F. to provide proper "fluffiness" or density. Alternatively the duration of applied heat, the speed of travel through, or length of, each furnace may be varied. The second and last stage furnaces are adjusted primarily to control the amount of drying of paper pulp insulation.

The amount of paper pulp applied from the vat 112 onto the conductor 110 may be adjusted so that there is a sufficient mass of insulation (of proper density) on the conductor. This may be done by adjusting the amount of paper pulp in the strip coating 115, e.g. by varying the slurry concentration, etc. It has been found that the cable may be made with a slightly different amount of refining i.e. with a Canadian Standard Freeness of 600 milliliters.

It has been found that a pair of insulated conductors in a completed cable has a mutual capacitance which satisfies the following equation.

$$C = \frac{0.019\epsilon_{ins}}{\log_{10}\frac{2s}{d} - 0.14}$$

where:

$C$ = the mutual capacitance = 0.083 mF/mile $\epsilon_{ins}$ = dielectric constant of the paper pulp insulation $s$ = diameter of the insulated conductor $d$ = diameter of the bare conductor Typical value for the various gauges described in this specification can be obtained from the following table.

| | 28 AWG | 26 AWG | 24 AWG | 22 AWG | 19 AWG |
|---|---|---|---|---|---|
| C | .083 | .083 | .083 | .083 | .083 |
| $\epsilon_{ins}$ (min) | 1.62 | 1.58 | 1.52 | 1.52 | 1.47 |
| (max) | 1.69 | 1.65 | 1.62 | 1.62 | 1.60 |
| $\frac{2s}{d}$ | 3.4 | 3.3 | 3.3 | 3.3 | 3.2 |

It has further been found that cables made in accordance with this invention yield an increase in the number of pairs for a given cable diameter over conventional cable in the order of 12 to 20%. Typical pair counts for a 3.10 inch diameter cable made in accordance with this invention and in accordance with conventional methods are given in the following table.

| Number of Pairs in a 3.10 inch ) .D. Cable | | |
|---|---|---|
| Conductor Size | Cable of the Present Invention | Conventional Cable |
| 28 AWG | 5400 | 4800 |
| 26 AWG | 3600 | 3000 |
| 24 AWG | 2100 | 1800 |
| 22 AWG | 1300 | 1100 |
| 19 AWG | 700 | 600 |

I claim:

1. A method of making paper pulp insulated cable of 28 guage copper conductor comprising the steps of forming a paper pulp slurry having an average fiber length of 2.5 mm and a freeness of 480, applying the wet paper pulp from said slurry to said conductor in the amount of approximately 0.0194 grams/foot, and heating said conductor and said applied paper pulp to approximately 1500° F., 1150° F., and 650° F. for approximately 2 seconds at each temperature, twisting said insulated wire into pairs, stranding said pairs into units, and cabling said units into a core, sheathing said core with at least one layer.

2. A method according to claim 1 further comprising the steps of adjusting the amount of paper pulp applied and the first temperature so that the thickness of said insulation is approximately 4 mil and its density is 0.42 to 0.46 grams/cm$^3$.

3. A method according to claim 2 further comprising the steps of adjusting said second and third temperatures primarily to dry the insulation.

4. A method of making paper pulp insulated cable of 22 guage copper conductor comprising the steps of forming a paper pulp slurry having an average fiber length of 2.5 mm and a freeness of 480, applying the wet paper pulp from said slurry to said conductor in the amount of approximately 0.0697 grams/foot, and heating said conductor and said applied paper pulp to approximately 1600° F., 1400° F., and 1100° F. for approximately 2 seconds at each temperature, twisting said insulated wire into pairs, stranding said pairs into units, and cabling said units into a core, sheathing said core with at least one layer.

5. A method according to claim 4 further comprising the steps of adjusting the amount of paper pulp applied and the first temperature so that the thickness of said insulation is approximately 8.6 mil and its density is 0.36 to 0.42 grams/cm$^3$.

6. A method according to claim 5 further comprising the steps of adjusting said second and third temperatures primarily to dry the insulation.

7. A method of making paper pulp insulated cable of 26 guage copper conductor comprising the steps of forming a paper pulp slurry having an average fiber length of 2.5 mm and a freeness of 480, applying the wet paper pulp from said slurry to said conductor in the amount of approximately 0.0286 grams/foot, and heating said conductor and said applied paper pulp to approximately 1600° F., 1150° F., and 875° F. for approximately 2 seconds at each temperature, twisting said insulated wire into pairs, stranding said pairs into units, and cabling said units into a core, sheathing said core with at least one layer.

8. A method according to claim 7 further comprising the steps of adjusting the amount of paper pulp applied and the first temperature so that the thickness of said insulation is approximately 5 mil and its density is 0.40 to 0.44 grams/cm$^3$.

9. A method according to claim 8 further comprising the steps of adjusting said second and third temperatures primarily to dry the insulation.

10. A method of making paper pulp insulated cable of 24 guage copper conductor comprising the steps of forming a paper pulp slurry having an average fiber length of 2.5 mm and a freeness of 480, applying the wet paper pulp from said slurry to said conductor in the amount of approximately 0.0491 grams/foot, and heating said conductor and said applied paper pulp to approximately 1600° F., 1300° F., and 1000° F. for approximately 2 seconds at each temperature, twisting said insulated wire into pairs, stranding said pairs into units, and cabling said units into a core, sheathing said core with at least one layer.

11. A method according to claim 10 further comprising the steps of adjusting the amount of paper pulp applied and the first temperature so that the thickness of said insulation is approximately 7 mil and its density is 0.36 to 0.42 grams/cm$^3$.

12. A method according to claim 11 further comprising the steps of a adjusting to dry the insulation.

13. A method of making paper pulp insulated cable of 19 guage copper conductor comprising the steps of forming a paper pulp slurry having an average fiber length of 2.5 mm and a freeness of 480, applying the wet paper pulp from said slurry to said conductor in the amount of approximately 0.1080 grams/foot, and heating said conductor and said applied paper pulp to approximately 1600° F., 1300° F., and 900° F. for approximately 2 seconds at each temperature, twisting said insulated wire into pairs, stranding said pairs into units, and cabling said units into a core, sheathing said core with at least one layer.

14. A method according to claim 13 further comprising the steps of adjusting the amount of paper pulp applied and the first temperature so that the thickness of said insulation is approximately 10.2 mil and its density is 0.33 to 0.41 grams/cm$^3$.

15. A method according to claim 14 further comprising the steps of adjusting said second and third temperatures primarily to dry the insulation.

16. A method of making cable having paper pulp insulation on the conductors comprising the steps of forming a paper pulp slurry, applying the paper pulp from the slurry to said conductors, heating said conductors and applied paper pulp to cause said paper pulp to fluff and have a dielectric constant in the range of 1.47 to 1.69, further heating to dry said insulation, twisting said insulated wire into pairs, stranding said pairs into units, and cabling said units into a core, sheathing said core with at least one layer of paper or metal and applying a waterproof outside jacket.

17. A method according to claim 16 wherein the diameter of said conductor is approximately 12.6 mil comprising the further step of adjusting said heating to fluff the diameter of said insulated conductor to 21.1 ± 0.4 mil and to give the insulation a dielectric constant of 1.65.

18. A method according to claim 16 wherein the diameter of said conductor is approximately 15.9 mil comprising the further step of adjusting said heating to fluff the diameter of said insulated conductor to 26.3 ±

0.4 mil and to give the insulation a dielectric constant of 1.62.

19. A method according to claim 16 wherein the diameter of said conductor is approximately 20.1 mil comprising the further step of adjusting said heating to fluff the diameter of said insulated conductor to 34.0 ± 0.4 mil and to give the insulation a dielectric constant of 1.56.

20. A method according to claim 16 wherein the diameter of said conductor is approximately 25.3 mil comprising the further step of adjusting said heating to fluff the diameter of said insulated conductor to 42.1 ± 0.4 mil and to give the insulation a dielectric constand of 1.56.

21. A method according to claim 16 wherein the diameter of said conductor is approximately 35.9 mil comprising the further step of adjusting said heating to fluff the diameter of said insulated conductor to 56.4 ± 0.4 mil and to give the insulation a dielectric constant of 1.53.

22. A method of making cable having paper pulp insulation on the conductors comprising the steps of forming a paper pulp slurry, applying the paper pulp from the slurry to said conductors, heating said conductors and applied paper pulp to cause said paper pulp to fluff and have dielectric constant in the range of 1.47 to 1.69, further heating to dry said insulation, twisting said insulated wire into pairs, forming said pairs into a core, and sheathing said core with at least one layer of paper or metal and applying a waterproof outside jacket.

23. A method of making cable having paper pulp insulation on the conductors comprising the steps of forming a paper pulp slurry, applying the paper pulp from the slurry to said conductors, heating said conductors and applied paper pulp to cause said paper pulp to fluff and have a dielectric constant in the range of 1.47 to 1.69, further heating to dry said insulation, twisting said insulated wire into pairs, forming said pairs into a core, sheathing said core with at least one layer of paper or metal and applying a waterproof outside jacket, and said first heating step fluffs said pulp so that the conductors of the pairs exhibit a capacitance of:

$$C = \frac{0.0194\epsilon_{ins}}{\log_{10}\frac{(2s)}{(d)} - 0.14}$$

where $C$ = mutual capacitance = 0.083 microfarads/mile $\epsilon_{ins}$ = dielectric constant of the paper pulp insulation = 1.47 to 1.69

$s$ = diameter of the insulated conductor $d$ = diameter of the conductor, and $2s/d$ = 3.2 to 3.4

* * * * *